United States Patent [19]

Kawasumi

[11] Patent Number: 4,610,147

[45] Date of Patent: Sep. 9, 1986

[54] ICE DETECTOR FOR AN ICE MAKING MACHINE

[75] Inventor: Masaaki Kawasumi, Shimane, Japan

[73] Assignee: Hoshizaki Electric Co., Ltd., Toyoake, Japan

[21] Appl. No.: 692,163

[22] Filed: Jan. 17, 1985

[30] Foreign Application Priority Data

Jan. 23, 1984 [JP] Japan ..... 59-6340[U]

[51] Int. Cl.[4] ..... F25C 50/18

[52] U.S. Cl. ..... 62/137; 200/61.21; 340/617

[58] Field of Search ..... 62/137; 340/616, 617, 340/624; 200/61.2, 61.21; 414/294–296; 116/227, 229; 73/308, 317

[56] References Cited

U.S. PATENT DOCUMENTS

| | | | |
|---|---|---|---|
| 2,698,362 | 12/1954 | Bozick | 340/617 X |
| 2,851,553 | 9/1958 | Grostick | 340/617 X |
| 3,045,444 | 7/1962 | Todd | 62/137 |
| 3,348,004 | 10/1967 | Carroll | 200/61.2 |
| 3,810,386 | 5/1974 | McAshan, Jr. | 200/61.21 |
| 3,885,400 | 5/1975 | Webb | 62/137 |
| 4,337,657 | 7/1982 | Morris | 340/624 X |
| 4,426,851 | 1/1984 | Neumann | 340/617 X |

*Primary Examiner*—William E. Tapolcai

*Attorney, Agent, or Firm*—Wenderoth, Lind & Ponack

[57] ABSTRACT

An ice detector for an ice making machine which includes an ice storage switch main body mounted to an inner ceiling wall of an ice reservoir and including a detecting switch, an ice product detecting lever pivotally mounted to a supporting shaft of main body and a stopper provided in reservoir for contacting with one end of the ice product detecting lever. The ice product detecting lever is held in a non-vertical position by the stopper. In the preferred embodiments, the stopper is integrally formed with the main body of the ice storage switch.

6 Claims, 3 Drawing Figures

ICE DETECTOR FOR AN ICE MAKING MACHINE

BACKGROUND OF THE INVENTION

The present invention relates to an ice product detector having an ice detecting lever for detecting the ice product in an ice making machine.

When applied for example to an ice product reservoir, as shown in FIG. 1, the conventional ice detector is comprised of a main body 2 of an ice storage switch mounted to the upper wall of the ice reservoir 1, an ice product detecting lever 3 carried by a supporting shaft 7 of the main body 2 of the switch and capable of coming in contact with the ice product in the reservoir, and an ice storage switch 5 having a movable lever 4 adapted for contacting the upper portion of the ice product detecting lever 3. The detecting lever can move in rotation about the supporting shaft 7 from the reset position (FIG. 1) to an ice product detecting position because of an opening 6 in the ice storage switch main body 2. In the reset position, the center of gravity of the ice product detecting lever 3 is on a plumb line passing through the supporting shaft 7, with the detecting lever 3 abutting on a stopper portion 8 of an ice storage switch main body 2. When the detecting lever 3 is rotated a certain angle counterclockwise, ice storage status is detected. In such conventional ice product detectors, when the ice making machine is mounted at an inclined position as shown in FIG. 2 with the opening 6 of the main body 2 facing downwards, the ice product detecting lever 3 cannot return to its reset position, whereby the detecting lever 3 is likely to actuate the ice storage switch 5 inadvertently through the movable lever 4, thus issuing an ice storage completion signal even when the reservoir is not completely filled with ice product.

Also when the ice product detecting lever 3 is formed of a resinous molding, it is likely to become curved or warped in its entirety. On such an occasion, there also is the risk that the above described erroneous operation of the ice storage switch 5 may take place through the deformation of the ice detecting lever portions abutting on the stopper portion 8 of the main body 2 of the ice storage switch 5.

SUMMARY OF THE INVENTION

The present invention has been made in order to overcome the above described defects of the prior art and contemplates as its object to provide an ice product detector of an ice making machine whereby the ice product detecting lever can positively return to its reset position even when the ice making machine is mounted at a small tilt or when the ice product detecting lever is deformed slightly. More specifically, the invention resides in an ice product detector for an ice making machine comprising an ice storage switch main body mounted to an inner ceiling wall of an ice reservoir and including a detecting switch, an ice product detecting lever pivotally mounted to a supporting shaft of said main body and a stopper portion provided in said reservoir for contacting with one end of said ice product detecting lever, wherein said ice product detecting lever is held in a non-vertical position by said stopper portion.

DESCRIPTION OF THE PREFERRED EMBODIMENT

The ice product detector according to a preferred embodiment of the present invention is hereinafter explained by referring to the accompanying drawings.

Figure 1:
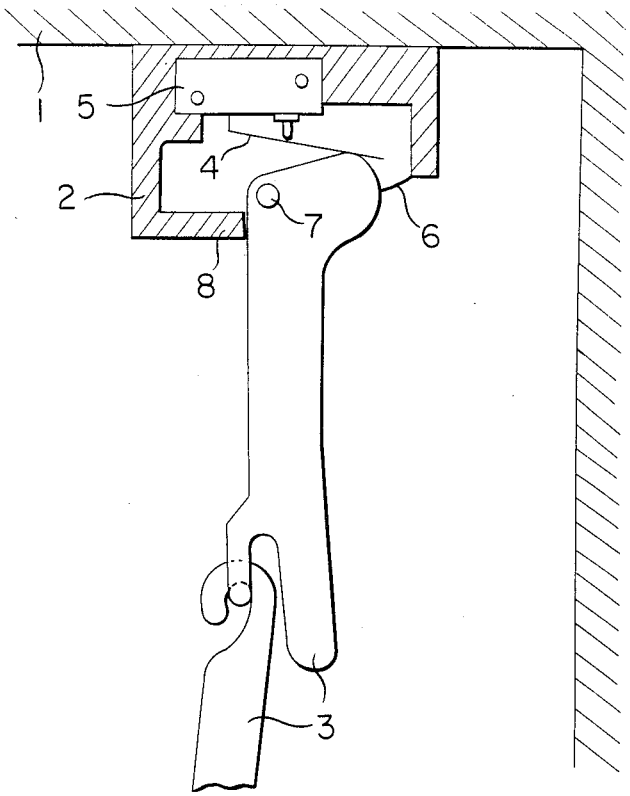
FIG. 1 (PRIOR ART)
FIG. 1 is a partial cross-sectional view of a conventional ice detector for an ice making machine.
Figure 2:
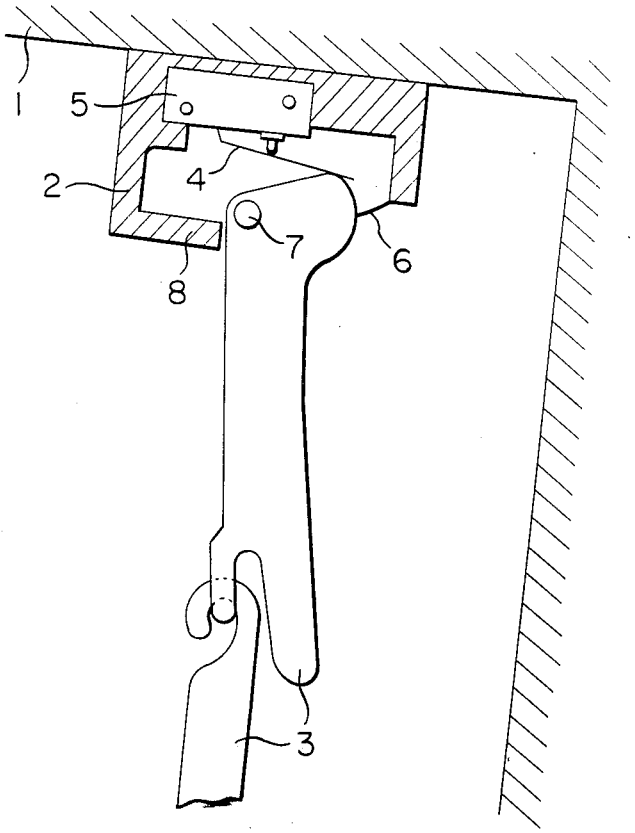
FIG. 2 (PRIOR ART)
FIG. 2 is a partial cross-sectional view showing the ice product detector of FIG. 1 when the ice making machine is mounted at an inclination.
Figure 3:
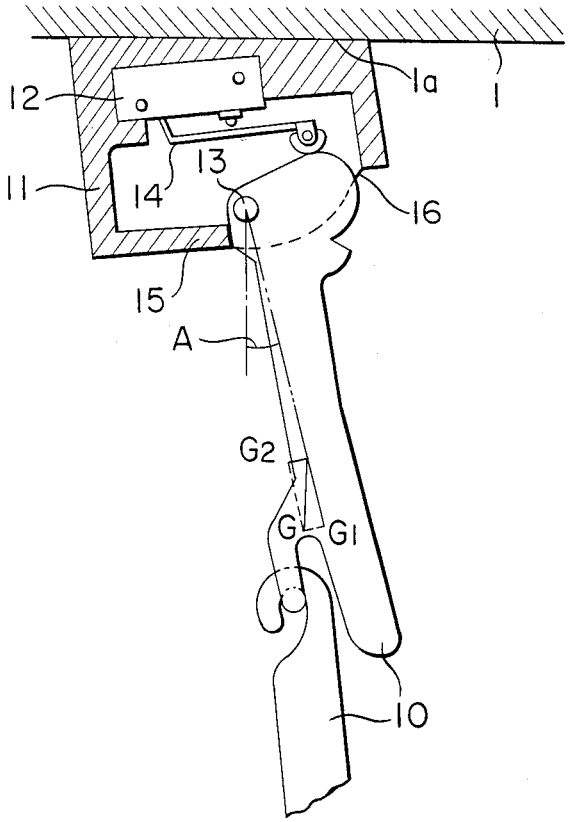
FIG. 3 is a partial cross-sectional view showing an ice product detector according to the present invention.

FIG. 3 shows an example in which the ice product detector of the present invention is applied to an ice product reservoir. Similarly to the conventional device shown in FIG. 1, the upper inner wall of the reservoir 1 is fitted with an ice storage switch main body 11 to which is mounted a microswitch 12 adapted for detecting the ice storage. The upper part of the ice product detecting lever 10 positioned within an opening 16 of the main body 11 is rotatably supported by a supporting shaft 13 provided in the ice storage switch main body 11. A movable lever 14 of the microswitch 12 contacts the upper surface of the detecting lever 10 in such a manner that rotation of the lever 10 causes the closing or opening of the microswitch 12. The status of ice storage is detected when the ice product detecting lever 10 contacts the stored ice products in the reservoir, and is thereby caused to pivot more than a predetermined angle. On the other hand, when the stored ice no longer contacts the ice detecting lever 10, the latter returns to its reset position shown in FIG. 3. In such position, the rotation of the lever 10 is terminated by the stopper portion 15 forming a part of the bottom of the ice storage switch main body 11.

Although the stopper 15 extends towards the opening 16, a stopper having a similar function as that of the stopper portion 15 may be provided on the ice detecting lever 10 without providing a stopper portion 15 on the main body of the switch 11. Alternatively, a separate stopper member 15 can also be independently provided on the reservoir for achieving similar results. The stopper portion 15 is so positioned that an angle A between the plumb line passing through an axis of the supporting shaft 13 and a straight line connecting the axis of the shaft 13 and the center of gravity of the detector lever 10 is well in excess of the allowable tilt angle of the ice making machine in respect to the horizontal. In this manner, the force of gravity G of the detecting lever 10 is resolved into a component $G_1$ along the straight line passing through the axis of the shaft 13 and the center of gravity of the ice detecting lever 10 and a component $G_2$ perpendicular to such straight line. The component $G_2$ provides a rotational moment whereby the lever 10 is caused to rotate clockwise so that a force is provided for normally urging the ice detecting lever 10 towards the stopper portion 15.

Thus, even in cases wherein the ice making machine is mounted with a small tilt within the allowable angular limit, as when the mounting surface 1*a* of the ice storage switch which is horizontal in FIG. 3 is tilted slightly to the front or rear or to the left or right, there is no possibility that the straight line connecting the axis of the shaft 13 and the center of gravity of the ice detecting lever 10 will become aligned with the plumb line passing through said axis.

Although the specific example of the present invention shown and described above relates to an ice detector device as applied for detecting a predetermined amount of ice products stored in an ice reservoir, the detector of the present invention may also be used for detecting the release of ice products from an inclined freezing plate of an ice making machine adapted for forming plate ice on an inclined freezing plate.

In the above described ice product detector of the present invention, even if the ice making machine is mounted with a certain tilt, the ice detecting lever is positively restored to its reset position for positively performing the ice detecting control operation. Similarly, even if the lever is deformed slightly, the detecting lever can be positively returned to its reset position. Since the effect is achieved solely by changing the profile of the main body of the ice storage switch, the device is trouble-free and can be manufactured at low cost with a simplified structure and a small number of parts and any other devices such as mechanical springs are dispensed with.

What is claimed is:

1. An ice detector for an ice making machine, comprising an ice storage switch having a main body for being mounted to an inner ceiling wall of an ice reservoir and a detecting switch, an ice product detecting lever pivotally mounted to a supporting shaft of said main body for engaging said detecting switch and a stopper provided in said reservoir in contact with one end of said ice product detecting lever for holding said ice product detecting lever in a non-vertical position so as to block pivotal movement of said ice product detecting lever toward a vertical position, said ice product detecting lever being pivotable from said non-vertical position in a direction away from the vertical position.

2. The ice detector according to claim 1, wherein said stopper is integrally formed with the ice storage switch main body.

3. The ice detector according to claim 1, wherein an upper part of the ice detecting lever is located within an opening in the main body of the ice storage switch and said top parts abuts on a movable lever of the actuating switch.

4. The ice detector according to claim 1, wherein said detecting lever is inclined at an angle defined between a straight line connecting the center of gravity of the detector lever and the axis of the supporting shaft and a vertical plumb line passing through said axis.

5. The ice detector according to claim 1, wherein the main body of the ice storage switch is mounted at an angle relative to the ceiling wall.

6. An ice detector according to claim 1, further comprising an ice reservoir having a horizontal inner ceiling wall, said main body being mounted to said inner ceiling wall.

* * * * *